US006621057B2

(12) United States Patent
Kim

(10) Patent No.: US 6,621,057 B2
(45) Date of Patent: Sep. 16, 2003

(54) HOODED MICROWAVE OVEN WITH INDEPENDENTLY FORMED EXHAUST AND COOLING AIRFLOW PASSAGES

(75) Inventor: Su-Hwan Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/898,020

(22) Filed: Jul. 5, 2001

(65) Prior Publication Data

US 2002/0084267 A1 Jul. 4, 2002

(30) Foreign Application Priority Data

Dec. 30, 2000 (KR) ..... 2000-87413

(51) Int. Cl.[7] ..... H05B 6/80

(52) U.S. Cl. ..... 219/757; 126/299 R; 126/21 A

(58) Field of Search ..... 219/757, 681, 219/756; 126/21 A, 299 R, 299 D, 275 E, 273 A

(56) References Cited

U.S. PATENT DOCUMENTS 4,314,126 A * 2/1982 Yoshimura et al. ..... 219/757
4,327,274 A * 4/1982 White et al. ..... 219/757
4,601,279 A * 7/1986 Guerin ..... 126/21 A
5,886,330 A * 3/1999 Kang et al. ..... 219/757
6,025,582 A * 2/2000 Kang et al. ..... 219/757
6,218,654 B1 * 4/2001 Braunisch ..... 219/757
6,369,372 B1 * 4/2002 Kim ..... 219/756

* cited by examiner

*Primary Examiner*—Philip H. Leung
(74) *Attorney, Agent, or Firm*—Fleshner & Kim, LLP

(57) ABSTRACT

A microwave oven is provided which has enhanced operating efficiency and which makes less noise by independently forming a flow of air for a hood function and a flow of air for cooling an electric equipment installation chamber and by mounting an exhaust filter only on one side of an air duct. The microwave oven includes a ventilation motor assembly for forming a flow of air for the hood function and a flow of air for cooling the electric equipment installation chamber. In addition, the flow of air discharged from the ventilation motor assembly is forced to flow through the air duct which has passages divided into a first duct portion and a second duct portion. Moreover, an exhaust filter is installed only in the duct portion through which the flow of air for the hood function passes. Furthermore, the electric equipment installation chamber is formed at an upper side of a cooking cavity so that the electric equipment is installed in a position adjacent to the ventilation motor assembly. With a microwave oven having such structure, the air flows smoothly, and noise due to the flow of air is minimized.

21 Claims, 4 Drawing Sheets

Fig. 2
CONVENTIONAL
ART
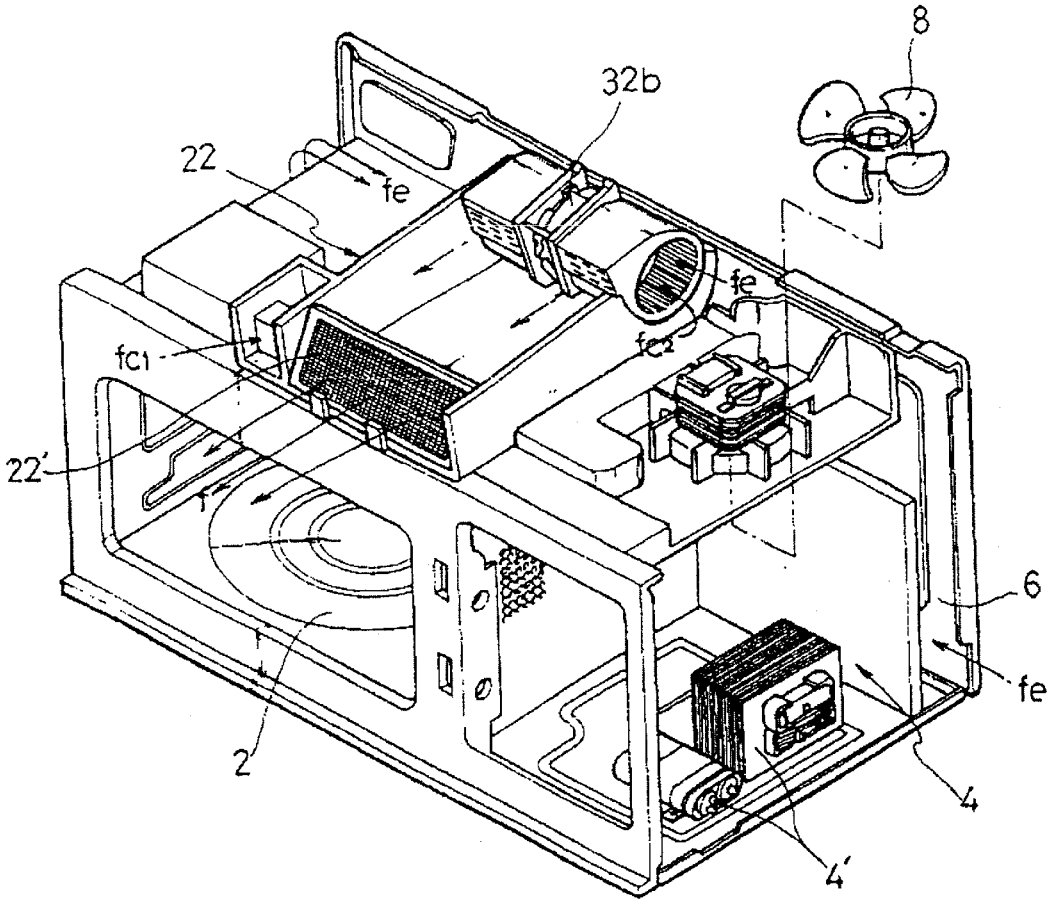

HOODED MICROWAVE OVEN WITH INDEPENDENTLY FORMED EXHAUST AND COOLING AIRFLOW PASSAGES

FIELD OF INVENTION

The present invention relates to a microwave oven, and more particularly, to a structure of hooded microwave oven in which exhaust and cooling airflow passages are independently formed and an exhaust filter is mounted only in the exhaust airflow passage so as to increase operating efficiency and to reduce flow noise.

BACKGROUND OF INVENTION

First, the constitution of a conventional hooded microwave oven will be described in detail with reference to FIG. 1. FIG. 1 is a perspective view of the conventional hooded microwave oven with an outer case thereof removed and an air duct thereof disassembled.

As shown in FIG. 1, a cavity 2 in which cooking is done is formed at one side of the microwave oven. An electric equipment installation chamber 4 is formed at one side of the cavity 2. A plurality of electric equipments 4' are mounted inside the chamber 4. In addition, a blowing fan 8 is mounted on the top of the chamber 4 to form a cooling air stream $f_d$ toward the chamber 4.

Furthermore, an exhaust inflow opening 6 is formed in the rear of a back wall of the chamber 4. The exhaust inflow opening 6 serves as a passage allowing hot air and smoke discharged from a gas oven range (not shown) installed under the microwave oven to flow into the microwave oven.

On the other hand, an air inflow portion 2*a* and an air outflow portion 2*b,* which are constructed by a plurality of passage holes and allow the air to flow into and out of the cavity 2, respectively, are formed on a top surface of the cavity 2. Additionally, a guide wall 2', which is placed adjacent the air inflow portion 2*a* to guide the air toward the air inflow portion 2*a,* is formed on the top surface of the cavity 2.

Moreover, an air duct 22 is mounted on the top of the cavity 2. The air duct 22 is a structure for guiding a sucked exhaust air stream fe of heat and smoke generated from the gas oven range (not shown) installed under the microwave oven toward the front side of the cavity 2. Engaging protrusions 22*c* are formed at a leading end of the air duct 22. Also, at the opposing positions of right and left side walls 22*a,* 22*b* of the air duct 22, a pair of support protrusions 22*a*', 22*b*' projecting from the respective side walls 22*a,* 22*b* are provided. Incline surfaces sloping up toward the rear of the air duct 22 are formed on top ends of the support protrusions 22*a*', 22*b*', respectively.

Additionally, an air introduction portion 22*d* is formed outside the left side wall 22*b* of the air duct 22. The air introduction portion 22*d* has a passage hole in the center portion thereof, and is formed in the shape surrounded by four side walls so as to guide the air downwardly through the passage hole. Furthermore, the air $f_{c1}$ that is flowed into the air introduction portion 22*d* is guided by the guide wall 2' toward the air inflow portion 2*a* ($f_{c2}$).

Moreover, a ventilation motor 32*c* provided with output shafts (not shown) at both ends thereof is mounted in the rear of the air duct 22. Sirocco fans 32*c* are mounted at the right and left sides of the ventilation motor 32*c,* respectively. The sirocco fans suck air in the direction of the output shafts (not shown) and discharge the air in the direction orthogonal to the output shafts (not shown). Hereinafter, the left sirocco fan is referred to as a left fan 32*b,* and the right sirocco fan is referred to as a right fan 32*a.*

In addition, exhaust openings 32*a*', 32*b*' are formed respectively at one side of each sirocco fan. The exhaust openings 32*a*', 32*b*' is directed to the air duct 22 to be described below.

Also, an exhaust filter 22' is mounted at a front side of the air duct 22. That is, a lower edge of the exhaust filter 22' is supported by the engaging protrusions 22*c* at the leading end of the air duct 22 and a rear surface of the exhaust filter 22' is supported by the incline surfaces at the top ends of the support protrusions 22*a*', 22*b*40 so that the exhaust filter 22' is mounted at the front side of the air duct 22 to thoroughly cover the front side of the air flow passage formed in the air duct 22. Absorbent material is densely filled in the exhaust filter 22'. By means of the absorbent material, toxic substance in the exhaust discharged through the air duct 22 is filtered so that clean air is discharged from the front side of the exhaust filter 22'.

On the other hand, FIG. 2 shows a state that the air duct 22 is mounted on the top of the cavity. Thus, since the air inflow portion 2*a* and the air outflow portion 2*b,* which are formed on the top surface of the cavity 2, are placed under the air duct 22, they are hidden. Moreover, at the leading end of the air duct 22, the exhaust filter 22' is obliquely mounted to slope toward the rear of the air duct 22.

Hereinafter, the flow of air formed inside the microwave oven in the prior art constructed as such will be described with reference to FIG. 2.

When the ventilation motor 32*c* is operated, contaminated air produced from the gas oven range (not shown) installed under the microwave oven is sucked through the right and left fans 32*a,* 32*b* of the ventilation motor 32*c* into the microwave oven and flows as indicated by the arrow $f_e$. That is, one portion of the contaminated air flowed into the rear side of the electric equipment installation chamber 4 of the microwave oven through exhaust inflow opening 6 flows toward the right fan 32*a,* and the other portion of the contaminated air flows toward the left fan 32*b.*

Meanwhile, as for the flow of air inside the cavity 2, air drawn into the microwave oven through a ventilation grill (not shown) installed at the left top side of the front of the cavity 2 flows toward the air inflow portion 2*a* through the air introduction portion 22*d* as indicated by the arrow $f_{c1}$. In addition, air drawn into the cavity 2 through the air inflow portion 2*a* evaporates moisture within the cavity 2, and the air containing the evaporated vapor is discharged from the top of the cavity 2 through the air outflow portion 2*b.* The air discharged from the air outflow portion 2*b* flows into the right fan 32*a* of the ventilation motor 32*c.*

As a result, the contaminated air discharged from the gas oven range (not shown) flows through the left fan 32*b* of the ventilation motor 32*c,* whereas not only the contaminated air but also the air containing the vapor in the cavity flows through the right fan 32*a.*

As described above, the air sucked into the ventilation motor 32*c* is discharged through each exhaust openings 32*a*', 32*b*' to the air duct 22, and passes through the exhaust filter 22' mounted at the leading end of the air duct 22 so as to be discharged forward of the microwave oven. Electric equipments 4' in the electric equipment installation chamber 4 are cooled by a separate blowing fan 8 which forms a stream of air by sucking the outside air.

However, the microwave oven having such structure in the prior art gives rise to problems as follows.

First, the contaminated air to be flowed into the right and left fans 32*a,* 32*b* of the ventilation motor 32*c* is generated only when the gas oven range is in operation. That is, when only the microwave oven is operated, the contaminated air does not flow into the right and left fans 32*a,* 32*b* of the ventilation motor 32*c*. However, even in such case, uncontaminated air discharged forward of the air duct 22 through the right fan 32*a* also unnecessarily passes through the exhaust filter 22'.

Accordingly, in such case, there is a problem in that the exhaust filter 22' does not function as a filter, but obstructs the flow of air passing through the right fan 32*a*. In addition, noise is made when the air passes through a dense filler within the exhaust filter 22'.

Moreover, due to the exhaust filter 22', discharging velocity of the air discharged from the right fan 32*a* is lowered so that air does not circulate smoothly in the cavity 2. Thus, the vapor in the cavity 2 is not discharged smoothly.

Furthermore, since the exhaust filter 22' does not have a structure for regulating its upward movement, it is often disengaged from the air duct 22 when an external force is applied thereto or it is moved. Then, there is also a problem in that the contaminated air is discharged without being filtered by the exhaust filter 22'.

SUMMARY OF INVENTION

Therefore, it is an object of the present invention to solve the problems of the prior art as mentioned above, more particularly, to make the flow of air within hooded microwave oven smoother.

It is another object of the present invention to minimize noise caused by the flow of air within the hooded microwave oven.

It is a further object of the present invention to make the flow of air within a cavity of the hooded microwave oven smooth.

It is a still further object of the present invention to form the flow of air within the microwave oven with relatively small number of components.

It is a still further object of the present invention to ensure the filtration of air by installing an exhaust filter more firmly.

According to features of the present invention for achieving the above objects, a hooded microwave oven comprises a cavity in which cooking is done; an electric equipment installation chamber which is formed at one side of the top of the cavity and in which electric equipments are mounted; a ventilation motor assembly which forms a flow of air for cooling the electric equipments and a flow of contaminated air by a hood function; and an air duct which independently separates the flow of contaminated air and the flow of air for cooling that are sucked into and discharged from the ventilation motor assembly and which has an exhaust filter mounted at a portion through which the contaminated air passes.

The ventilation motor assembly may be provided with fans at both ends of a ventilation motor, respectively, and the air duct is provided with a first and second duct portions which separately communicate with the respective fans.

The exhaust filter may be detachably and obliquely installed, from the front of the air duct, on the duct portion through which the contaminated air passes.

The air duct may be provided with support protrusions of which top ends slope to support obliquely a rear surface of the exhaust filter, thereby mounting the exhaust filter; top end protrusions which press and support one side of a top surface of the exhaust filter are provided at both sides of a leading end of the air duct; and engaging protrusions which engage a leading end of the exhaust filter are formed at the leading end of the air duct.

The electric equipment installation chamber in which the electric equipments are installed may be formed at a level adjacent to the fan of the ventilation motor.

The fan of the ventilation motor may suck air from the electric equipment installation chamber and may form a flow of air in the chamber.

According to the present invention having such constitution, efficient flow of air can be obtained since the flow of air for the hood function and the flow of air for cooling are separated, and the effect that a storing space of the cavity can be expanded horizontally by forming the electric equipment installation chamber at the top of the cavity can be expected, and the ventilation motor can be utilized efficiently because both the flow of air for cooling the electric equipments and the flow of air for the hood function can be carried out by one ventilation motor.

BRIEF DESCRIPTION OF THE DRAWINGS

FIG. 2 is a perspective view showing a flow of air within the conventional hooded microwave oven.

DETAILED DESCRIPTION FOR PREFERRED EMBODIMENT

Hereinafter, hooded microwave oven according to the present invention will be explained in detail with reference to a preferred embodiment shown in the accompanying drawings.

Figure 1:
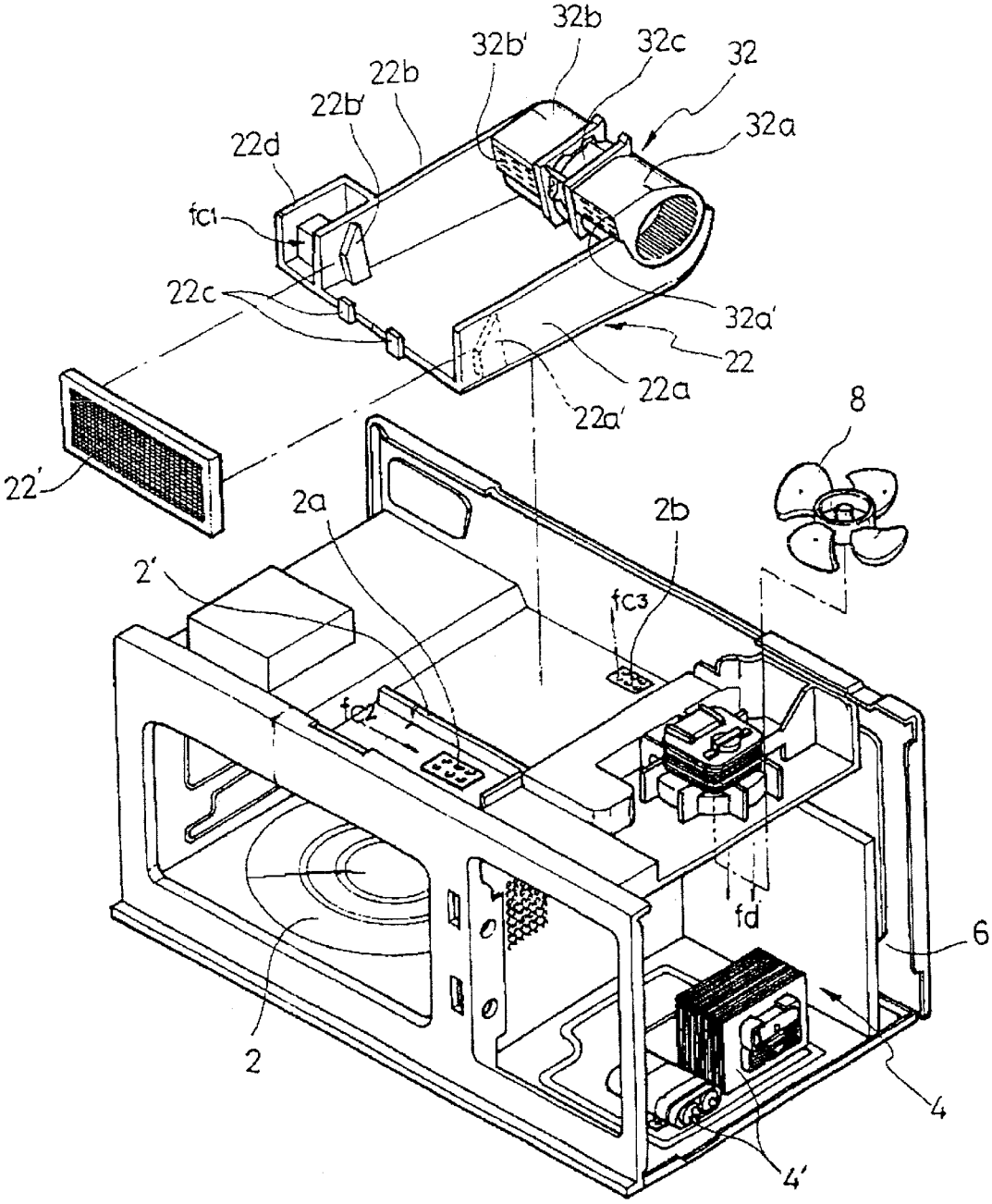
Fig.1 CONVENTIONAL ART
FIG. 1 is a perspective view of principal parts of a conventional hooded microwave oven with an air duct thereof disassembled.
Figure 3:
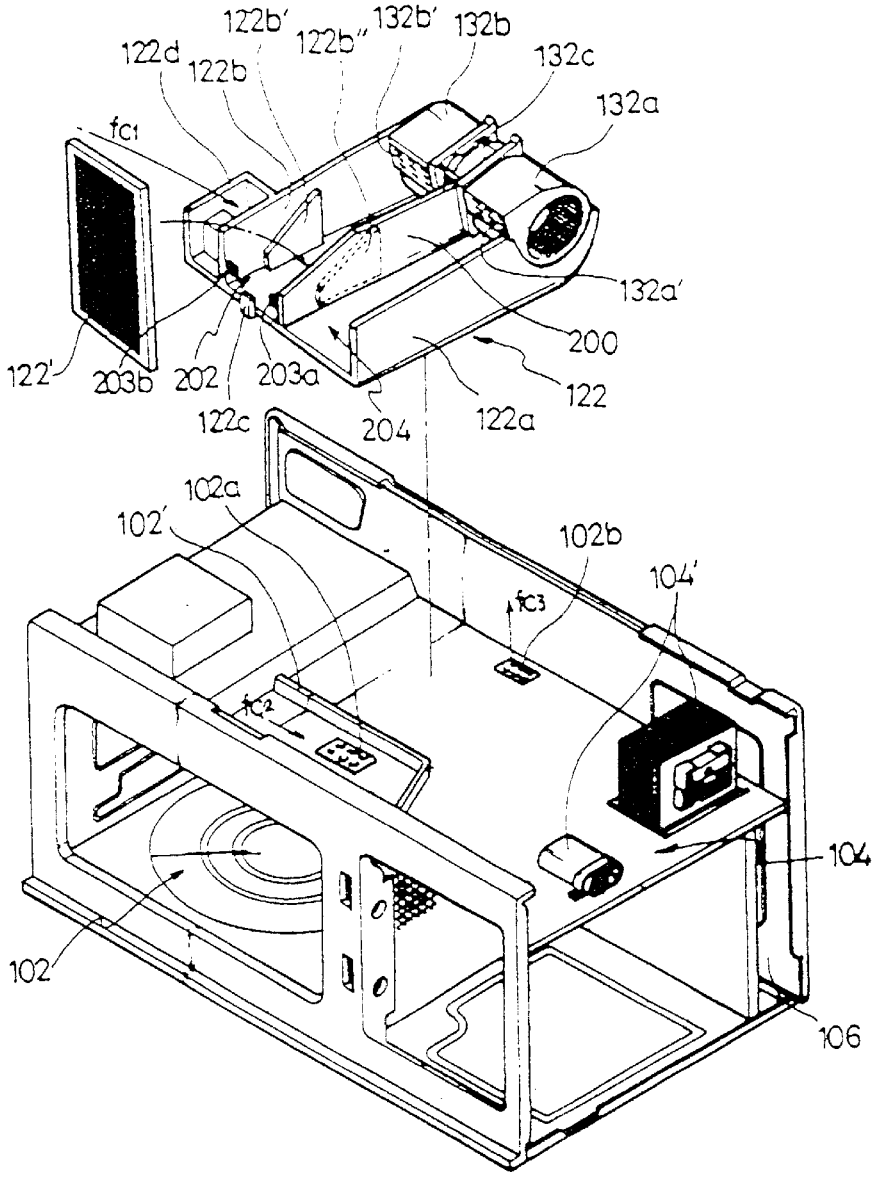
FIG. 3 is an exploded perspective view showing the constitution of a preferred embodiment of hooded microwave oven according to the present invention.
Figure 4:
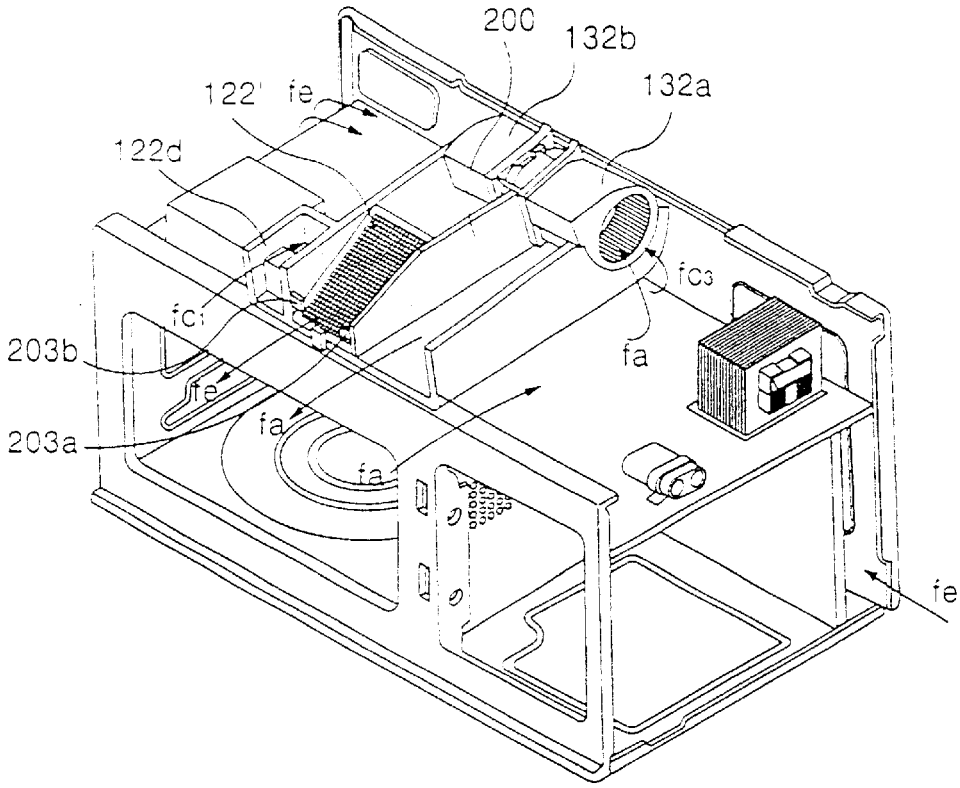
FIG. 4 is a perspective view showing a flow of air within the hooded microwave oven according to the embodiment of the present invention.

As shown in FIGS. 3 and 4, a cavity 102 in which a cooking space is provided is formed in one side of the microwave oven. A plurality of passage holes are formed on a top surface of the cavity 102 to form an air inflow portion 102*a* which allows air to flow into the cooking space and an air outflow portion 102*b* which allows the air flowed thereinto to flow out.

In addition, a guide wall 102', which guides the air drawn into an air introduction portion 122*d* to be described below toward the air inflow portion 102*a* and partitions the air inflow portion 102*a* and the air outflow portion 102*b,* is formed on the top surface of the cavity 102. A bottom surface of an air duct 122 to be described below comes in close contact with the top surface of the guide wall 102'.

An electric equipment installation chamber 104 in which electric equipments 104' are mounted is formed on one side of the cavity 102. Moreover, an empty space is formed under the chamber 104, i.e. at the right side of the cavity 102. An exhaust inflow opening 106 through which contaminated air generated from a gas oven range installed under the microwave oven passes into the microwave oven is formed in the rear of the empty space. In addition, a space which causes the contaminated air drawn through the exhaust inflow opening 106 to flow to the right and top side of the cavity 102 is formed in the rear of the cavity 102.

On the other hand, the air duct 122, which allows the air within the microwave oven to be discharged therefrom, is mounted at the top of the cavity 102. Both right and left ends of the air duct 122 are defined by right and left side walls 122*a,* 122*b,* and a separate partition wall 200 is formed between the right and left side walls 122*a,* 122*b* to form first and second duct portions 202, 204 in the air duct 122. The upper parts of the first and second duct portions 202, 204 are shielded when the outer case (not shown) of the microwave oven is mounted thereon.

Furthermore, support protrusions 122*b*', 122*b*" are formed in both side walls of the first duct portion 202 among the first and second duct portions 202, 204, i.e. in the left wall 122*b* of the air duct 122 and in the partition wall 200, respectively. The support protrusions 122*b*', 122*b*" are integrally formed to protrude from the left side wall 122*b* and the partition wall 200, respectively, and top surfaces of the support protrusions are formed to slope upwardly toward the rear of the first duct portion 202. A bottom surface of an exhaust filter 122' to be described below is obliquely supported by the sloped top surfaces.

In addition, top end protrusions 203*a,* 203*b* are formed in the left wall 122*b* and the partition wall 200. The top end protrusions 203*a,* 203*b* restrict a top surface of the exhaust filter 122' not to move beyond a predetermined height. Such top end protrusions 203*b,* 203*a* are formed at a distance from the support protrusions 122*b*', 122*b*".

On the other hand, an engaging protrusion 122*c* is formed at a leading end of the air duct 122 to protrude upward in such a manner that a leading end of the exhaust filter 122' can engage it.

By the above-mentioned structure, when the exhaust filter 122' is installed in the first duct portion 202, the rear side thereof is supported by the sloped surfaces of the support protrusions 122*b*', 122*b*", and the leading end thereof engages and is placed on the leading end of the engaging protrusion 122*c*. The top end protrusions 203*a,* 203*b* restrict the exhaust filter 122' not to move beyond a predetermined height. Toxic substance absorbing material is densely filled in the exhaust filter 122' so as to remove the toxic substances in the contaminated air passing through the first duct portion 202.

On the other hand, an air introduction portion 122*d* is formed at the outside of the left side wall 122*b* of the air duct 122. The air introduction portion 122*d* guides the air drawn through a ventilation grill (not shown) installed at the front side of the upper part of the cavity 102 toward the air inflow portion 102*a* of the cavity 102.

Next, a ventilation motor assembly 132 is mounted at the rear of the air duct 122. The ventilation motor assembly 132 includes a ventilation motor 132*c* provided with output shafts (not shown) at both ends thereof and sirocco fans coupled to the output shafts of the ventilation motor 132*c*. Hereinafter, the sirocco fan mounted on the left side will be referred to as a left fan 132*b,* and the sirocco fan mounted on the right side will be referred to as a right fan 132*a*. By operating the ventilation motor 132*c,* the right and left fans 132*a,* 132*b* suck air in the direction of the output shaft (not shown) of the ventilation motor 132*c,* and discharge the air through exhaust openings 132*a*', 132*b*' in the direction orthogonal to the output shaft (not shown).

Furthermore, since the exhaust openings 132*a*', 132*b*' are formed to face the front of the air duct 122, the streams of air formed by the right and left fans 132*a,* 132*b* flow toward the front of the air duct 122. Moreover, the right and left fans 132*a,* 132*b* discharge the sucked air independently through the first and second duct portions 202, 204, respectively.

Namely, since the left fan 132*b* is installed in the rear of the first duct portion 202, and the right fan 132*a* is installed in the rear of the second duct portion 204, respectively, the flows of air sucked by the right and left fans 132*a,* 132*b* are discharged independently through the first and second duct portions 202, 204.

Hereinafter, the operation of the combination hood and microwave oven according to the present invention will be described in detail with reference to FIG. 4.

When the ventilation motor 132*c* is operated, the contaminated air discharged from the gas oven range installed under the microwave oven is drawn into the exhaust inflow opening 106 to flow as indicated by the arrow $f_e$. That is, the contaminated air flows through the space formed in the rear of the cavity 102 toward the left top side of the cavity 102. The air flowed toward the left top side of the cavity 102 is sucked into the left fan 132*b* of the ventilation motor assembly 132.

Then, the air is discharged through the first duct portion 202 toward the front of the air duct 122. At this time, the air is discharged from the front of the microwave oven after toxic substances in the air are filtered by the exhaust filter 122' installed at the front of the first duct portion 202.

On the other hand, the flow of air for cooling the electric equipments 104' is formed through the right fan 132*a* of the ventilation motor assembly 132. That is, negative pressure is generated within the electric equipment installation chamber 104 by the operation of the right fan 132*a,* whereby external air is sucked into the chamber 104 from the front thereof.

In addition, the air sucked by the right fan 132*a* is discharged through the second duct portion 204 toward the front of the air duct 122. At this time, since the exhaust filter 122' is not mounted in the second duct portion 204, the air is discharged outside in unfiltered state. Such flow of air is indicated by the arrow $f_a$ in FIG. 4.

Moreover, the air $f_{c3}$ that flows through the interior of the cavity 102 and is then discharged through the air outflow portion 102*b* flows toward the electric equipment installation chamber 104 and is transferred to the right fan 132*a*. Then, it is discharged from the front side of the second duct portion 204 together with the air having cooled the chamber 104.

On the other hand, the exhaust filter 122' is detachably mounted at the front side of the first duct portion 202. That is, in a state that the exhaust filter 122' is sufficiently inserted into a space between the engaging protrusion 122*c* and the top end protrusions 203*a,* 203*b,* the leading end of the exhaust filter 122' is engaged with the engaged protrusion 122*c* while its rear side is supported by the support protrusions 122*a*', 122*b*'. The exhaust filter 122' can be removed in reverse order.

Thus, according to the hooded microwave oven of the present invention, the following effects can be expected.

First, the flows of air for the hood function and for cooling formed within the hooded microwave oven are independently separated, and the filter can be effectively used by installing the filter only in the passage of contaminated air.

In addition, the air passing through the passage in which a filter is not installed can flow more smoothly, and at the same time, the volume of air that does not pass through the filter is relatively increased so that the flow noise is reduced.

Furthermore, since the flows of air for the hood function and for cooling are formed only by the ventilation motor assembly, the ventilation motor can be utilized more effectively.

Moreover, since the electric equipment installation chamber is formed at the top of the cavity, the space for cavity can be expanded horizontally, or a separate component for an additional function can be installed to enhance its cooking performance.

In mounting the exhaust filter, since the exhaust filter is not accidentally dismounted from the air duct by forming the upward protrusions for regulating the upward movement of the exhaust filter, the microwave oven can be transported in a state that the exhaust filter is assembled in the air duct.

Finally, since the air discharged from the air outflow portion of the cavity flows through the second duct portion in which the exhaust filter is not mounted, the air can flow more smoothly in the cavity so that the dewing in the cavity is effectively prevented.

Although the present invention has been described in detail with respect to the preferred embodiment of the invention, it should be understood that a person having an ordinary skill in the art to which the present invention pertains can make various modifications and changes to the present invention without departing from the spirit and scope of the invention defined by the appended claims. Therefore, further modifications to the embodiment of the invention will fall within the scope of the invention.

What is claimed is:

1. A microwave oven that functions as a hood for an oven located below the microwave oven, comprising:

a cavity in which cooking is done;

an electric equipment installation chamber which is formed at one side above the top of said cavity and in which electric equipments are mounted;

a ventilation motor assembly which forms a flow of air for cooling said electric equipments and a flow of contaminated air from an oven located below the microwave oven for which the microwave oven is providing a hood function; and an air duct which independently separates said flow of contaminated air and said flow of air for cooling that are sucked into and discharged from said ventilation motor assembly, wherein the air duct has first and second discharge portions that extend in parallel along an upper portion of the microwave oven through which the cooling air and contaminated air are discharged from the microwave oven without being intermingled, and wherein an exhaust filter is mounted only in one of the first and second discharge portions through which said contaminated air passes.

2. The microwave oven as claimed in claim 1, wherein said ventilation motor assembly is provided with fans at both ends of a ventilation motor, respectively, wherein the first and second discharge portions separately communicate with said respective fans.

3. The microwave oven as claimed in claim 2, wherein said electric equipment installation chamber in which said electric equipments are installed is formed at a level adjacent to said fans of said ventilation motor.

4. The microwave oven as claimed in claim 3, wherein said fan of said ventilation motor is configured to suck air from said electric equipment installation chamber and forms a flow of air in said chamber.

5. The microwave oven as claimed in claim 2, wherein the fans are disposed substantially adjacent to one another.

6. The microwave oven as claimed in claim 2, wherein the fans are disposed at an upper rear portion of the microwave oven.

7. The microwave oven as claimed in claim 1, wherein said exhaust filter is detachably and obliquely installed at the front of said air duct through which said contaminated air passes.

8. The microwave oven as claimed in claim 1, wherein the first and second discharge portions extend in parallel from a rear to a front of the microwave oven.

9. A microwave oven that functions as a hood for an oven located below the microwave oven, comprising:

a cavity in which cooking is done;

an electric equipment installation chamber which is formed at one side above the top of said cavity and in which electric equipments are mounted;

a ventilation motor assembly which forms a flow of air for cooling said electric equipments and a flow of contaminated air from an oven located below the microwave oven for which the microwave oven is providing a hood function; and an air duct which independently separates said flow of contaminated air and said flow of air for cooling that are sucked into and discharged from said ventilation motor assembly and which has an exhaust filter mounted at a portion through which said contaminated air passes, wherein said air duct is provided with support protrusions of which top ends slope so as to support obliquely a rear surface of said exhaust filter, thereby mounting said exhaust filter; top end protrusions which press and support one side of a top surface of said exhaust filter are provided at both sides of a leading end of said air duct; and engaging protrusions which engage a leading end of said exhaust filter are formed at said leading end of said air duct.

10. A microwave oven configured to function as a hood for an oven located below the microwave oven, comprising:

a cavity in which items are subjected to microwaves;

an electric equipment installation chamber positioned adjacent to the cavity;

a ventilation motor assembly configured to form a first flow of air for cooling electric equipment disposed in the electric equipment installation chamber and a second flow of air contaminated by and received from the oven located below the microwave oven; and an air duct having first and second discharge portions that prevents intermingling of the first and second air flows as the first and second air flows are sucked into and discharged from the ventilation motor assembly, wherein the second discharge portion is provided with a plurality of support protrusions, a top end of each support portion being slanted so as to obliquely support a rear surface of the exhaust filter, one or more engaging protrusions configured to engage a leading edge of the exhaust filter, and a plurality of top end protrusions configured to engage a top surface of the exhaust filter at both sides.

11. A microwave oven configured to function as a hood for an oven located below the microwave oven, comprising:

a cavity in which items are subjected to microwaves;

an electric equipment installation chamber positioned adjacent to the cavity;

a ventilation motor assembly configured to form a first flow of air for cooling electric equipment disposed in the electric equipment installation chamber and a second flow of air contaminated by and received from the oven located below the microwave oven; and an air duct that prevents intermingling of the first and second air flows as the first and second air flows are sucked into and discharged from the ventilation motor assembly, the air duct comprising first and second discharge portions that extend in parallel along an upper portion of the microwave oven and through which the first and second air flows are discharged from the microwave oven without being intermingled.

12. The microwave oven as claimed in claim 11, wherein an exhaust filter is provided in only the second discharge portion of the air duct.

13. The microwave oven as claimed in claim 12, wherein the exhaust filter is detachably and obliquely installed at a downstream end of the second discharge portion.

14. The microwave oven as claimed in claim 11, wherein the first and second discharge portions are disposed horizontally adjacent to one another.

15. The microwave oven as claimed in claim 11, wherein the ventilation motor assembly comprises a ventilation motor configured to drive first and second fans, wherein the first and second discharge portions communicate with the first and second fans, respectively, disposed substantially adjacent to one another.

16. The microwave oven as claimed in claim 15, wherein the electric equipment installation chamber is formed at a level adjacent to the first fan.

17. The microwave oven as claimed in claim 15, wherein the first fan draws the first air flow through the electric equipment installation chamber and the first duct portion, thereby cooling electric equipment in the electric equipment installation chamber, and discharges the first air flow through the first discharge portion, and wherein the second fan draws the second air flow containing contaminated air from the oven disposed below the microwave oven through the second duct portion and discharges the second air flow through the second discharge portion.

18. The microwave oven as claimed in claim 17, further comprising an exhaust filter disposed in the second discharge portion.

19. The microwave oven as claimed in claim 15, wherein the first and second fans are disposed substantially adjacent to one another.

20. The microwave oven as claimed in claim 15, wherein the first and second fans are disposed at an upper rear portion of the microwave oven.

21. The microwave oven as claimed in claim 11, wherein the first and second discharge portions extend in parallel from a rear to a front of the microwave oven.

* * * * *